US005774141A

United States Patent [19]

Cooper et al.

[11] Patent Number: 5,774,141

[45] Date of Patent: Jun. 30, 1998

[54] CARRIAGE-MOUNTED INKJET AEROSOL REDUCTION SYSTEM

[75] Inventors: Brently L. Cooper, Brush Prairie; Jeffrey G. Patrick, Vancouver; Donald R. Bloyer, Brush Prairie; Larry G. Neubauer, Vancouver, all of Wash.; Robert K. Beretta, Cambridge, Mass.

[73] Assignee: Hewlett-Packard Company, Palo Alto, Calif.

[21] Appl. No.: 548,836

[22] Filed: Oct. 26, 1995

[51] Int. Cl.[6] ..... B41J 2/165; B41J 2/215; B41J 2/175

[52] U.S. Cl. ..... 347/34; 347/83; 347/93

[58] Field of Search ..... 347/34, 83, 93

[56] References Cited

U.S. PATENT DOCUMENTS

| | | | |
|---|---|---|---|
| 3,851,582 | 12/1974 | Saueressig et al. | 101/181 |
| 3,854,224 | 12/1974 | Yamaji et al. | 34/77 |
| 3,981,020 | 9/1976 | Takano et al. | 346/75 |
| 4,024,548 | 5/1977 | Alonso et al. | 346/140 R |
| 4,340,893 | 7/1982 | Ort | 346/1.1 |
| 4,358,192 | 11/1982 | Goldberg et al. | 354/299 |
| 4,361,845 | 11/1982 | Smith | 346/146 |
| 4,369,450 | 1/1983 | Iwagami et al. | 346/75 |
| 4,414,755 | 11/1983 | Ericsson | 34/4 |
| 4,628,331 | 12/1986 | Ishikawa | 346/75 |

(List continued on next page.)

FOREIGN PATENT DOCUMENTS

| | | | |
|---|---|---|---|
| 0118216 A1 | 9/1984 | European Pat. Off. | H01G 7/02 |
| 0325854 A1 | 8/1989 | European Pat. Off. | B03C 3/28 |
| 0332422 | 9/1989 | European Pat. Off. . | |
| 0616831 A1 | 9/1994 | European Pat. Off. | B01D 39/16 |
| 3417376 | 11/1984 | Germany . | |
| 4118645 | 6/1991 | Germany . | |
| 60-87054 | 5/1985 | Japan . | |
| 32758 | 2/1986 | Japan | 346/76 PH |
| 62-109645 | 5/1987 | Japan . | |
| 62-135369 | 6/1987 | Japan . | |
| 62-251147 | 10/1987 | Japan . | |
| WO-9009621 | 8/1990 | WIPO | 34/155 |

OTHER PUBLICATIONS

Patent Abstracts of Japan, vol. 11, No. 330 (M–636) Oct. 28, 1987, JP–A 62 111 749 (Matsushita Electric Ind Co Ltd) May 22, 1987.

Patent Abstracts of Japan, vol. 14, No. 172 (M–958) Apr. 4, 1990, JP–A 22 6 751 (Matsushita Electric Ind Co Ltd) Jan. 29, 1990.

Hewlett–Packard Patent Application S/N 08/171129 filed Dec. 20, 1993.

Hewlett–Packard Patent Application S/N 08/372541 filed Jan. 13, 1995.

Hewlett–Packard Patent Application S/N 08/198658 filed Feb. 18, 1994.

Hewlett–Packard Patent Application S/N 08/419160 filed Apr. 10, 1995.

Hewlett–Packard Patent Application SN 08/390343 filed on Feb. 16, 1995.

*Primary Examiner*—Peter S. Wong
*Assistant Examiner*—Rajnikant B. Patel
*Attorney, Agent, or Firm*—Flory L. Martin

[57] ABSTRACT

An aerosol reduction system collects stray ink aerosol generated by inkjet printheads includes ventilation and collection components. During printing and purging, the printhead ejects ink to generate a desired ink droplet and a by-product comprising floating ink satellites. The aerosol collection system may be either passive or active, with the passive devices relying upon carriage motion to bring the collection elements into contact with the aerosol collection location. The passive systems have collection elements mounted on the carriage, including a rigid electrostatic filter, a billowing sail shaped filter geometry, or electrically charged plates. The active systems use some additional mechanism to bring the aerosol and the collection location together, such as the carriage-mounted aerosol removal or extraction fans illustrated. The collection location of these active systems may be mounted at the carriage, or well behind the carriage.

24 Claims, 7 Drawing Sheets

U.S. PATENT DOCUMENTS

| | | | |
|---|---|---|---|
| 4,668,959 | 5/1987 | Jochimsen et al. | 346/1.1 |
| 4,728,963 | 3/1988 | Rasmussen et al. | 346/25 |
| 4,751,528 | 6/1988 | Spehrley, Jr. | 346/140 R |
| 4,928,112 | 5/1990 | Hock et al. | 346/25 |
| 4,959,660 | 9/1990 | Suzuki et al. | 346/1.1 |
| 4,970,528 | 11/1990 | Beaufort et al. | 346/25 |
| 5,021,805 | 6/1991 | Imaizumi et al. | 346/76 R |
| 5,041,846 | 8/1991 | Vincent et al. | 346/25 |
| 5,055,861 | 10/1991 | Murayama et al. | 346/140 R |
| 5,060,572 | 10/1991 | Waizmann | 101/424.1 |
| 5,155,497 | 10/1992 | Martin et al. | 346/1.1 |
| 5,270,738 | 12/1993 | Takahashi et al. | 346/140 |
| 5,287,123 | 2/1994 | Medin et al. | 346/140 R |
| 5,296,873 | 3/1994 | Russell et al. | 346/25 |
| 5,298,926 | 3/1994 | Fukushima et al. | 346/140 R |
| 5,329,295 | 7/1994 | Medin et al. | 346/25 |
| 5,406,316 | 4/1995 | Schwiebert et al. | 347/18 |
| 5,428,384 | 6/1995 | Richtsmeier et al. | 347/102 |
| 5,446,487 | 8/1995 | Russell et al. | 347/102 |
| 5,496,507 | 3/1996 | Angadjivand et al. | 264/423 |
| 5,563,639 | 10/1996 | Cameron et al. | 347/34 |

CARRIAGE-MOUNTED INKJET AEROSOL REDUCTION SYSTEM

FIELD OF THE INVENTION

The present invention relates generally to inkjet printing mechanisms, and more particularly to a carriage-mounted aerosol reduction system for collecting stray ink aerosol generated by inkjet printheads, with the aerosol reduction system being supported by the carriage that carries the printheads.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead moves back and forth across the page shooting drops as it moves. To clean and protect the printhead, typically a "service station" mechanism is mounted to the printer chassis. For storage, or during non-printing periods, service stations usually include a capping system which seals the printhead nozzles from contaminants and drying. Some caps are also designed to facilitate priming, such as by being connected to a pumping unit that draws a vacuum on the printhead.

During operation, clogs in the printhead are periodically cleared by firing a number of drops of ink through each of the nozzles in a process known as "spitting." Typically, the waste ink is collected in a stationary reservoir portion of the service station, which is often referred to as a "spittoon." After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide faster, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, spitting to clear the nozzles becomes even more important when using pigment based inks, because the higher solids content contributes to the clogging problem more than the earlier dye based inks.

Unfortunately, spitting, as well as printing, generates ink aerosol or satellites, which are about 0.1–5.0 micron-sized airborne ink particles that are generated every time the printhead ejects an ink droplet of a desired size for printing or spitting. To enhance the resolution of the printed image, the number of dots-per-inch (dpi rating) has increased in recent years, yielding a larger number of smaller ink droplets being generated. This increase in dpi rating also increases the amount of aerosol particles which are generated by the printheads. Ink droplets larger than 5.0 microns usually impact in the desired location, either on the print media, or in the service station spittoon, rather than becoming airborne satellites. Since the new pigment based inks need more spitting than dye based inks to refresh the nozzles, due in part to the higher resolutions and the higher solids content, there are more opportunities to generate aerosol when using these new inks.

The small size and mass of these aerosol particles allows them to float in the air, migrating to settle in a variety of undesirable locations, including surfaces inside the printer. Motion of the printhead carriage generates air currents that may carry the ink aerosol onto critical components, such as the carriage position encoder optics, the encoder strip, and the printhead carriage bearing surfaces. Aerosol fogging of the optical encoder components may cause opacity, as well as light scattering or refraction, resulting in the loss of carriage position or velocity information. The aerosol may also land on the printed circuit boards of the printer controller. Since the ink aerosol contains chemicals, including salts, the printed circuit board components may be damaged or fail due to corrosion from aerosol contact. This migrating ink aerosol may also increase friction and cause corrosion of moving components, as well as degrading the life of critical components. For example, ink aerosol may accumulate along the printhead carriage guide rod, decreasing bushing life and increasing friction during normal operation.

In addition, this aerosol may settle on work surfaces near the printer, where it can then be transferred to an operator's fingers, clothing or other nearby objects. When the pen fires to print an image, many of these extraneous aerosol droplets land on the page, rather than floating around inside the printer. Unfortunately, these extraneous droplets may then degrade print quality. Efforts to improve reliability have also contributed to the aerosol problem. For example, low evaporation rate solvents have been employed to address the nozzle clogging problem discussed above. Unfortunately, these solvents cause the aerosol droplets to dry very slowly, if at all, once deposited inside the printer.

SUMMARY OF THE INVENTION

One aspect of the present invention addresses the inkjet aerosol problem by providing an inkjet printing mechanism with an ink aerosol collection system. The printing mechanism has an inkjet printhead that selectively ejects ink within an enclosure to print, with this ink ejection generating airborne ink aerosol within the enclosure. The printing mechanism also has a carriage that reciprocally moves the printhead across a print zone to print. The ink aerosol collection system is mounted on the carriage and includes an electrostatic collection member that electrostatically collects at least a portion of the airborne ink aerosol from within the enclosure to provide cleaned air.

According to another aspect of the invention, a method is provided of operating an inkjet printing mechanism to control airborne ink aerosol generated by ejecting ink from an inkjet printhead. The method includes the steps of ejecting ink through an inkjet printhead to generate a desired ink droplet and a by-product comprising floating ink satellites. In a depositing step, the desired ink droplet is deposited at a selected location. During a portion of the ejecting step, the printhead is moved with a carriage. In a supporting step, at least a portion of an ink aerosol collection system is supported with the carriage, with the collection system including an electrostatic collection member. In a capturing step, at least a portion of the floating ink satellites are electrostatically captured with the electrostatic collection member.

An overall object of the present invention is to provide an inkjet printing mechanism which prints sharp vivid images, and which preferably does so using a fast drying pigment based ink.

A further object of the present invention is to provide a method of collecting stray airborne ink aerosol generated by inkjet printheads during operation.

DETAILED DESCRIPTION OF THE PREFERRED EMBODIMENTS

Figure 1:
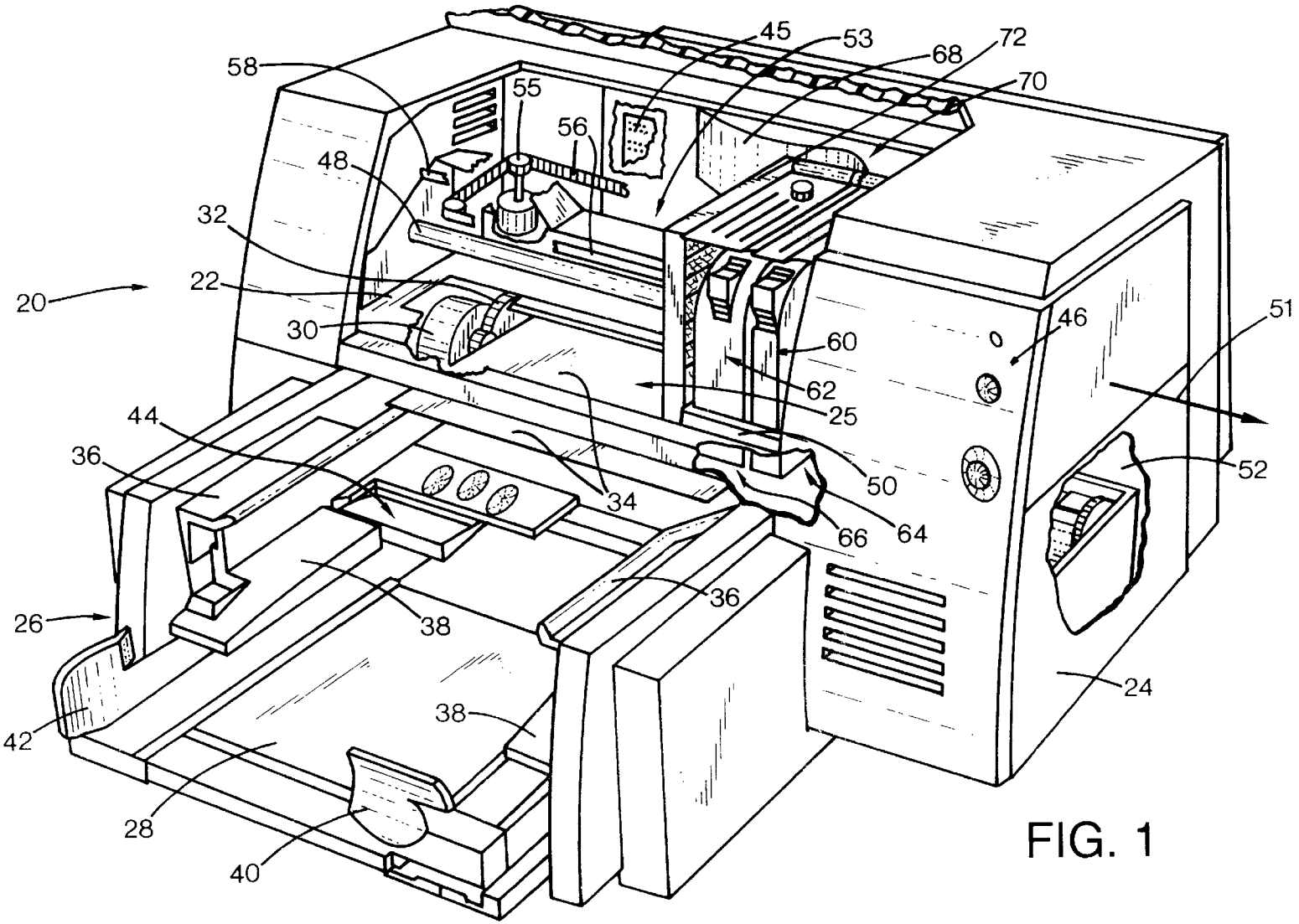
FIG. 1 is a partially schematic perspective view of one form of an inkjet printing mechanism incorporating a first embodiment of a carriage-mounted inkjet aerosol collection system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, facsimile machines, and various multi-function devices, to name a few. For convenience the concepts of the present invention are illustrated in the environment of an inkjet printer 20.

While it is apparent that the printer components may vary from model to model, the typical inkjet printer 20 includes a chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a DC servo or stepper motor and drive gear assembly 30, may be used to move the print media from tray 28 into the print zone 25, as shown for sheet 34, for printing.

After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40 and a sliding width adjustment lever 42. The media handling system 26 also has a sliding feed plate 44 that accommodates narrow media, such as envelopes, or hand feeding of a single sheet, for instance, letterhead.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support an inkjet carriage 50 for travel back and forth across the print zone 25 along a scanning axis 51. One suitable type of carriage support system is shown in U.S. Pat. No. 5,366,305, assigned to Hewlett-Packard Company, the assignee of the present invention. The carriage 50 is also propelled along guide rod 48 into a servicing region housing a service station 52, located within the interior of the casing 24. The chassis 22, the casing 24, and other components located in the enclosure define a carriage chamber 53 through which the carriage 50 travels from printing positions over the print zone 25, to servicing positions over the service station 52. The service station 52 may be any type of servicing device, sized to service the particular type of printing cartridge used in a particular implementation. Service stations, such as those used in commercially available printers, typically include wiping, capping and priming devices, as well as a spittoon portion, as described above in the background portion. One suitable preferred service station is commercially available in the Hewlett-Packard Company's DeskJet® 850C and 855C color inkjet printers.

The printer 20 also has a carriage drive DC motor and gear assembly 55, which is coupled to drive an endless belt 56. The motor 55 operates in response to control signals received from the printer controller 45. The belt 56 may be secured in a conventional manner to the pen carriage 50 to incrementally advance the carriage along guide rod 48 in response to rotation of motor 55.

To provide carriage positional feedback information to printer controller 45, an encoder strip 58 extends along the length of the print zone 25 and over the service station 52. A conventional optical encoder reader may also be mounted on the back surface of printhead carriage 50 to read positional information provided by the encoder strip 58. The manner of providing positional feedback information from the encoder strip reader to the controller may be accomplished in a variety of different ways known to those skilled in the art.

In the print zone 25, the media sheet 34 receives ink from an inkjet cartridge, such as a black ink cartridge 60 and/or a color ink cartridge 62. The cartridges 60 and 62 are also often called "pens" by those skilled in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink. The pens 60, 62 have printheads 64, 66 respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include substrate layer having a plurality of resistors which are associated with the nozzles. Upon energizing a selected resistor, a bubble of gas is formed to eject a droplet of ink from the nozzle and onto sheet 34 in the print zone 25. Ink may also be ejected into a spittoon portion of the service station 52 during servicing, or to clear plugged nozzles. The printhead resistors are selectively energized in response to firing command control signals delivered by a multi-conductor strip 68 from the controller 45 to the printhead carriage 50.

FIRST EMBODIMENT

Electrostatic Filter Elements

Figure 2:
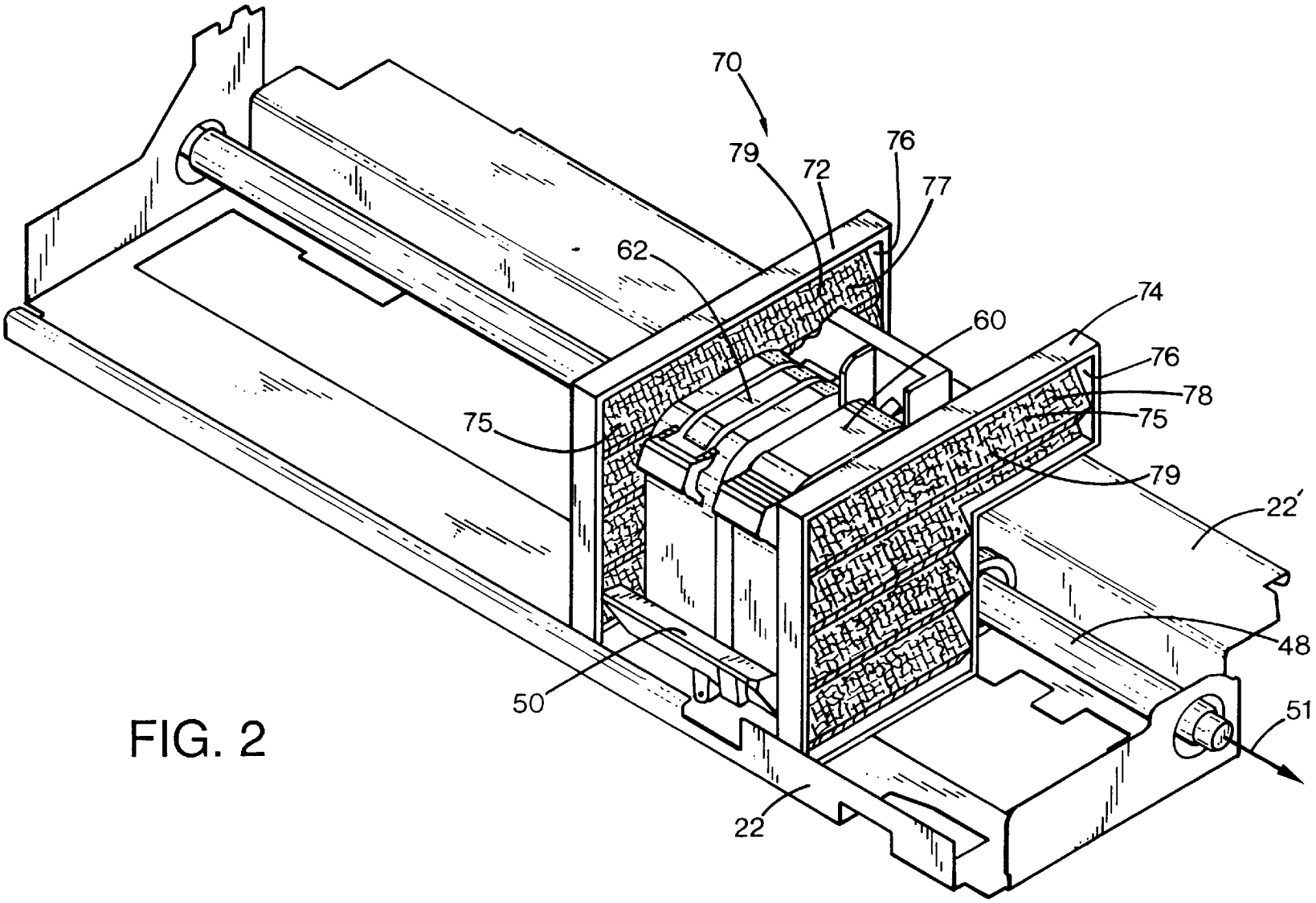
FIG. 2 is an enlarged perspective view of the carriage-mounted aerosol collection system of FIG. 1.

FIG. 2 shows a first embodiment of a carriage-mounted inkjet aerosol collection system, here an electrostatic filter aerosol collection system 70 constructed in accordance with the present invention to capture at least a portion of the ink aerosol generated during both printing and purging. The collection system 70 includes a pair of entrapment elements 72, 74 secured to each side of the carriage 50. The illustrated entrapment elements 72, 74 each comprise a filter segment 75 supported by a filter frame member 76. In this orientation, each filter segment 75 inboard surface 77 facing toward the carriage 50, and an opposing outboard surface 78 facing away from the carriage.

The filter frames 76 may be of a plastic material, or of a cardboard, craft paper or equivalent which may be preferable for a replaceable embodiment of the filter element 72, 74. The filter frames 76 may be permanently or replaceably mounted to each side of the carriage 50, in a variety of ways known to those skilled in the art, such as by unitarily molding the frames 76 with the carriage 50. Alternatively, the frames 76 may be bonded, such as by adhesive, by ultrasonic bonding techniques, or other manners known to those skilled in the art. As a further alternative, the filter frames 76 may be received within slots and/or snap hooks formed within the carriage 50, or they may be secured to the carriage by fasteners, such as screws, clips, etc. In the illustrated embodiment, the frames 76 are adhered by an industrial adhesive to the carriage frame 50.

For each entrapment element 72, 74, the filter segment 75 is preferably a micron level filter composed of a fabric with an impressed electrostatic charge. This charge is imparted to the filter fabric by applying a positive static charge to a portion of the filter fibers, and a negative static charge to another portion of the fibers, resulting in a net neutral charge for the total filter fabric. One suitable electrostaticly charged filter is sold as 3M Filtrete™ air filter media, by the 3M Company of St. Paul, Minn. In particular, the GSB-50 style of 3M Filtrete™ media is preferred, although other equivalent materials known to those skilled in the art may also be used. Preferably, the filter media is a split fiber media made of electrostatically charged polypropylene fibers having a density of about 75 $nC/cm^2$, a basis weight of about 50 $g/m^2$, with a reinforcing scrim to provide strength and uniformity, and an optional cover web. To increase filtering efficiency and/or capacity without impacting air flow, the filter media is preferably pleated, corrugated, or fan-folded, as shown. The electrostatic charge imparted to the fibers of filter segment 75 efficiently attracts the ink aerosol particles. For instance, the preferred filter media was found to be about 85% efficient at removing 1.0 micron sized and larger particles.

Preferably, the filter elements 72, 74 are sized with a filtration area that approximately occupies the available cross-sectional area of the carriage chamber 53 inside the casing 24, including the carriage travel path and the adjacent free areas. For instance, in FIG. 2 the filter elements 72, 74 not only surround the carriage 50, but they each also have a wing portion 79 that extends over a rearwardly extending portion 22' of the chassis 22. With this preferred sizing of the filters, the reciprocal action of the carriage 50 as it moves back and forth parallel to the scanning axis 51 allows the carriage to act as a piston. That is, the air within the printer enclosure 24 is forced through the filter elements. The inboard surfaces 77 of filter segments 75 capture aerosol escaping from the regions of the printheads 64, 66, while the outboard surfaces trap aerosol that has already escaped into the housing 24. The aerosol particles are captured as the air passes through the filter media 75.

In an alternate embodiment, the filter frame 76 may be modified to force the air emerging from the print zone 25 (FIG. 1) through the filter element 75 as the carriage 50 moves. For example, the filter frame 76 may be modified by adding a suitable angled deflecting vane to channel the aerosol-laden air into the filter. Alternatively, the filter frame 76 may be modified by changing the geometry of the bottom of the filter frame 76 into one that scoops the aerosol-laden air from the printzone 25, then directs it through the filter element 75. Such a scooping mechanism is preferably spaced far enough above the print media 34 to prevent contact and resulting smearing of the printed image.

An advantage of mounting the entrapment elements 72, 74 on the carriage 50, is that aerosol is captured whether it is generated during printing in the print zone 25, or during purging, where the nozzles of printheads 64, 66 are cleared by spitting over a spittoon portion (not shown) of the service station 52. Additionally, this system 70 is relatively low in cost to implement, since expensive fans are not required. Indeed, this embodiment of the carriage mounted aerosol reduction system 70 may be considered to be a "passive" system, because no additional moving parts, such as fans, are required to be added to the product.

As a further advantage, the system 70 has relatively few design impacts on a printing mechanism, because it consumes relatively little space and may be easily implemented or retrofitted into existing printer designs. Another advantage of the system 70 is that the filtered air is returned to the interior of the printer enclosure 24, without requiring that additional "make up" air be supplied to the printer interior. Additionally, the system 70 has minimal acoustic impact.

For ease of customer use, either the filter segment 75 or the entire entrapment portions 72, 74 may be designed for easy customer replacement. For instance, it may be particularly advantageous to replace the filter media at the same time that the printheads 64, 66 are being replaced, in either a semi-permanent printhead unit (not shown) or in a replaceable cartridge unit as shown.

SECOND EMBODIMENT

Sail Filter Elements

Figure 3:
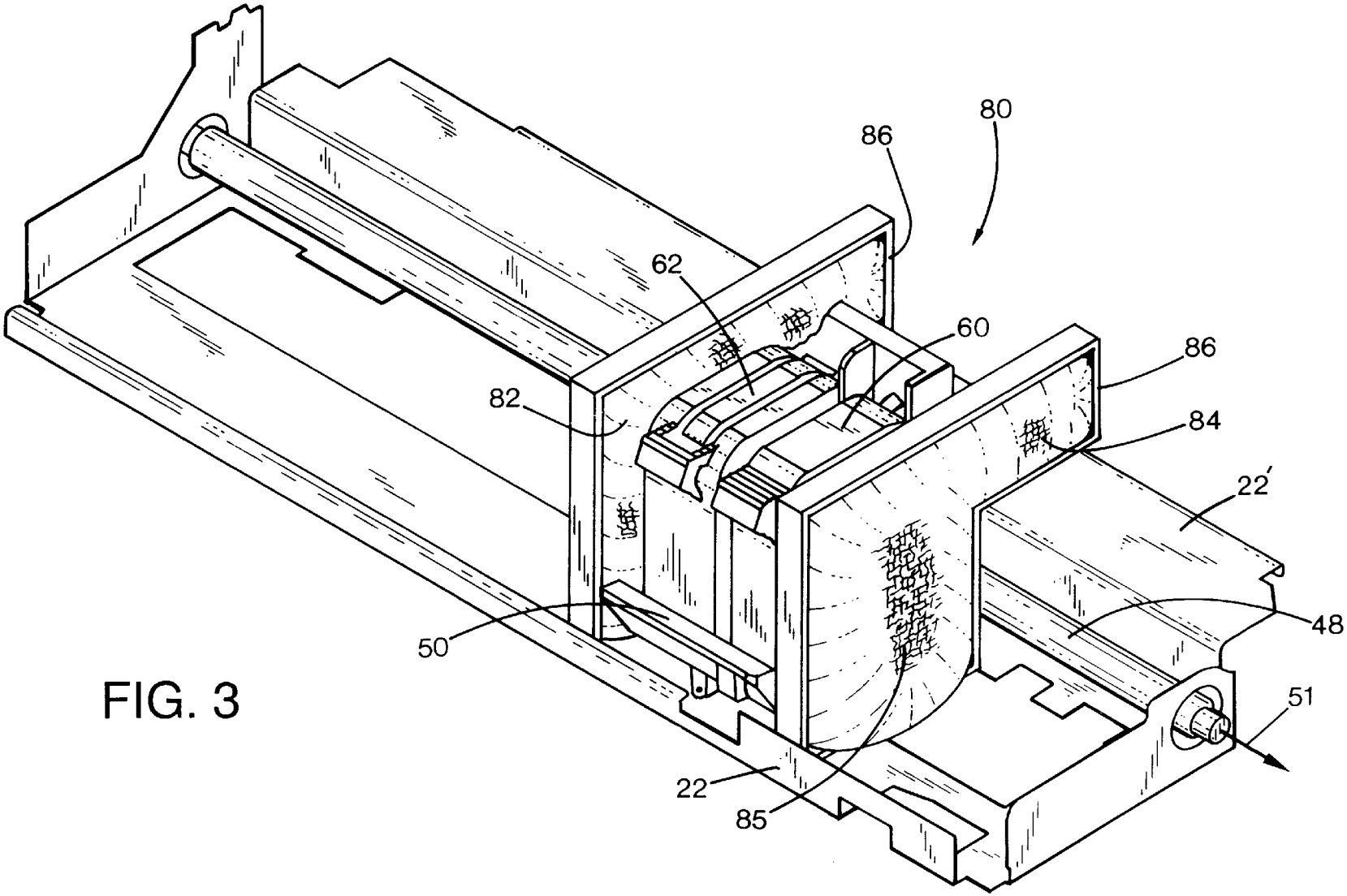
FIG. 3 is an enlarged perspective view of a second alternate embodiment of a carriage-mounted aerosol collection system of the present invention.

FIG. 3 illustrates a second embodiment of a carriage-mounted inkjet aerosol collection system, here as a sail filter aerosol collection system 80 constructed in accordance with the present invention. In this embodiment, filter entrapment elements 82, 84 are again mounted to each side of the carriage 50, for instance, in one of the manners described above, but preferably by adhesion or bonding. Each of the entrapment elements, 82, 84 replace the fan-folded filter element 75 of FIG. 2 with a billowing sail filter element 85, secured at its outer edges within a filter frame member 86.

Preferably, the billowing sail filter element 85 is of the same filter media as described above for filter segment 75, although other structurally equivalent materials may also be used, particularly if imparted with similar electrostatic properties. The billowing nature of the sail filter fabric 85 may advantageously capture more of the floating aerosol satellites within the printer enclosure 24 than a rigid filter element, such as the fan folded element 75. For example, when the carriage 50 moves to the left in FIG. 3, the sail fabric of element 84 billows in an outward direction to the right, whereas the fabric of filter element 82 billows in an inboard direction toward the pens 60, 62. The sail filter system 80 provides a variety of the same advantages as described above for system 70, including its passive nature, relatively low cost to implement, minimal design impact, minimal acoustic impact, ease of user replacement and its lack of need for make-up air being returned to the printer enclosure.

THIRD EMBODIMENT

Electrically Charged Plates

Figure 4:
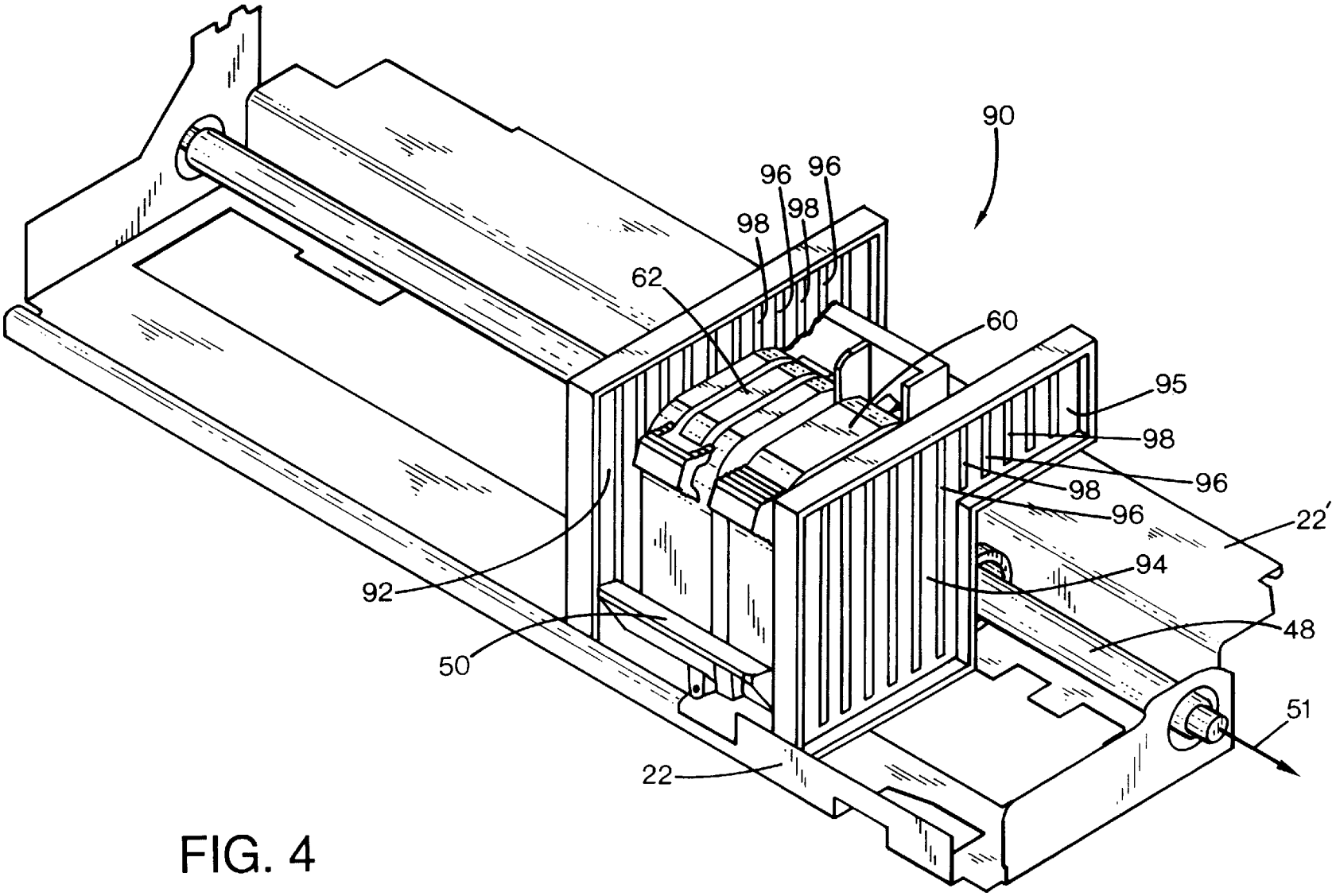
FIG. 4 is an enlarged perspective view of a third alternate embodiment of a carriage-mounted aerosol collection system of the present invention.

FIG. 4 illustrates a third embodiment of a carriage-mounted inkjet aerosol reduction system, here an electrically charged surface aerosol collection system 90 constructed in accordance with the present invention. In this embodiment, two entrapment elements 92, 94 are mounted to each side of the printer carriage 50. The entrapment elements, 92, 94 each include a support structure, such as a plate 95, preferably of an insulative material, such as plastic. Formed along the inboard side, and optionally, along the outboard side of the charged plate 95 are a series of alternating positively and negatively charged strips 96, 98. These strips may be metallic in nature, with preferably all the positive strips electrically coupled together, and all the negative strips electrically coupled together in a manner that ensures operator safety. For example, applying a floating voltage charge of approximately 2,000 volts at an almost zero current to strips 96, 98, there is no danger to an operator.

The positively and negatively charged strips 96, 98 may then be powered by electrical current received through the conductor strip 68 (FIG. 1), which also provides the control signals for firing the printheads 64 and 66. The positively charges strips 96 attract negatively charged ink aerosol ions, whereas the negatively charged strips 98 attract positively charged ink ions floating within the enclosure 24. While the inboard charged surfaces of plates 95 are advantageous for capturing aerosol generated during printing and spitting, by charging the outboard surfaces too, any aerosol which escapes entrapment by the inboard surfaces may then be captured as the carriage 50 moves during operation.

FOURTH EMBODIMENT

Carriage-Mounted Fan and Filter

Figure 5:
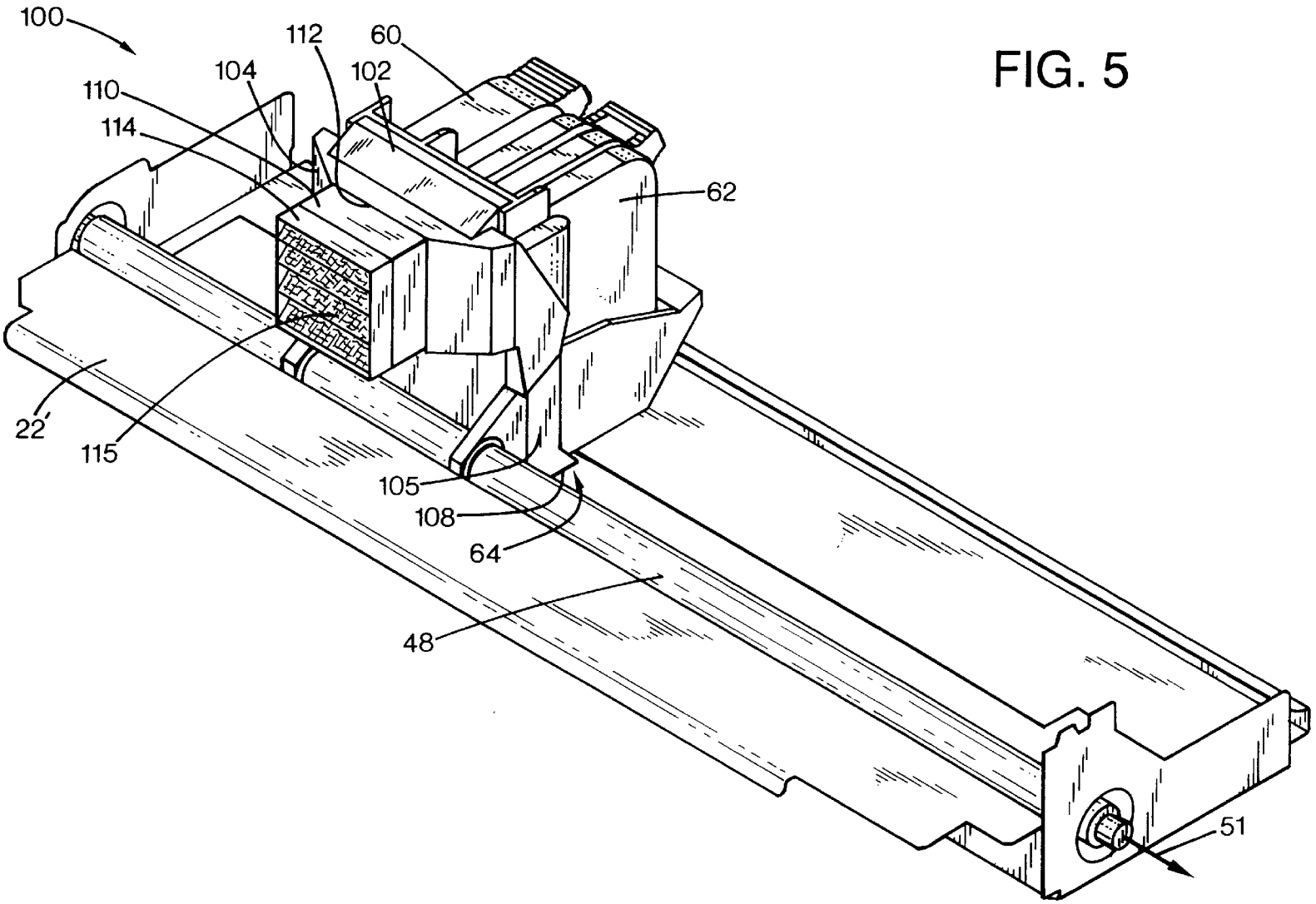
FIG. 5 is an enlarged perspective view of fourth alternate embodiment of a carriage-mounted aerosol collection system of the present invention.
Figure 6:
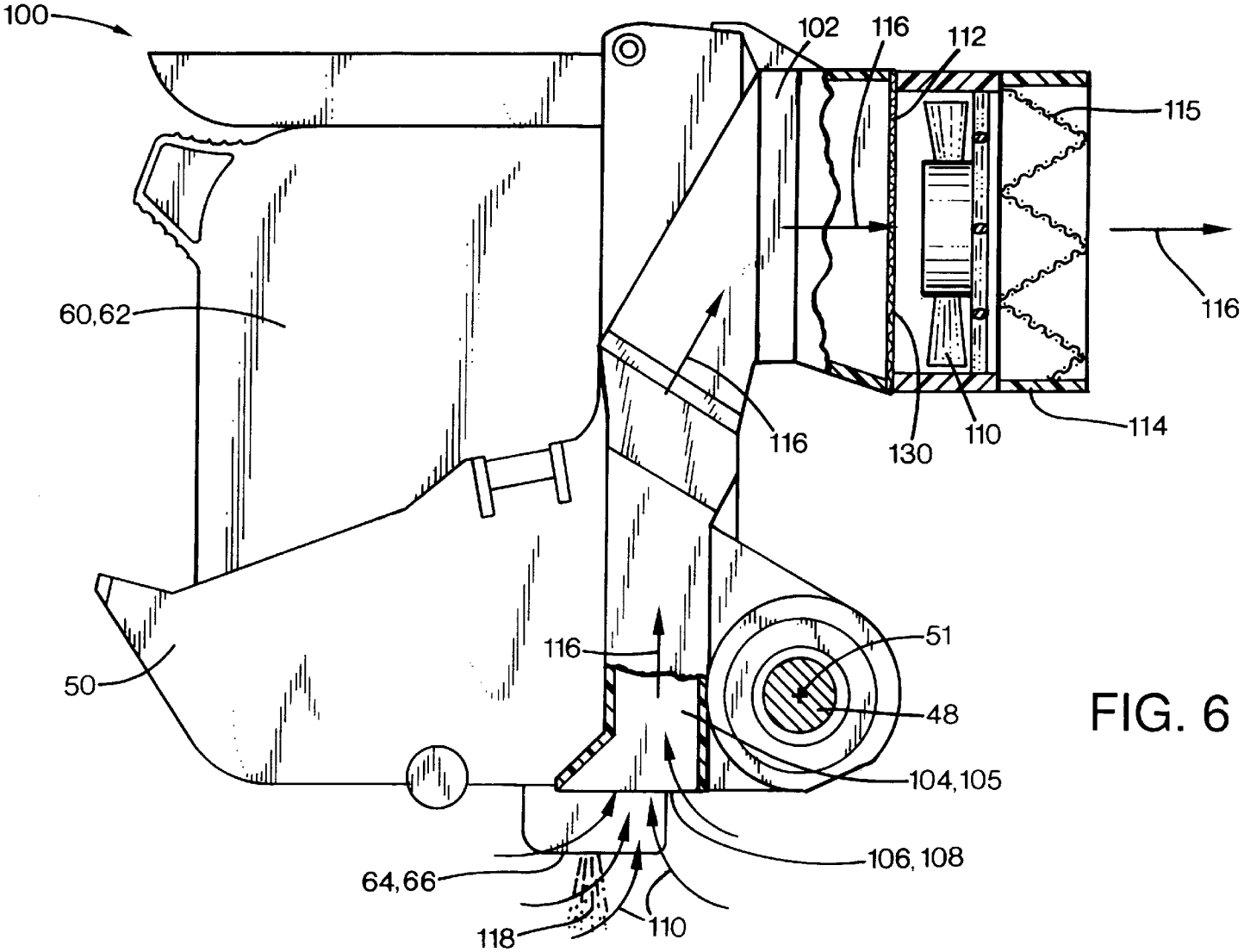
FIG. 6 is a side elevational view of the carriage-mounted aerosol collection system of FIG. 5.

FIGS. 5 and 6 illustrate a fourth embodiment of a carriage-mounted inkjet aerosol entrapment system, here a carriage-mounted extraction fan and electrostatic filter system 100 constructed in accordance with the present invention. The extraction system 100 includes a manifold assembly 102 with a pair of aerosol gathering intake ducts 104, 105 extending along each side of the carriage 50, and terminating at inlet ducts 106, 108, respectively. Preferably, the inlets 106, 108 are located adjacent the outer-most edges of the printheads 64, 66 to immediately receive airborne aerosol generated by the printheads.

The collection system 100 also has a ventilation component, such as an extraction fan unit 110, coupled to an outlet duct 112 of the manifold 102. The extraction fan 110 pulls air through the intake ducts 104 and 105 to provide a vacuum next to the aerosol emitting printheads 64 and 66, which draws the aerosol into the inlets 106, 108. The fan 110 may be any type of air movement device, such as a centrifugal fan, a compressed air source, or piezo-electric waving blades, for instance. In the illustrated embodiment, the ventilation component comprises a boxer or tubeaxial fan unit 100, such a DC brushless motor driven fan, rated at 12 volts DC, and 0.21 amperes.

The extraction system 100 may be considered to be an active system, as opposed to the passive systems 70, 80 and 90 described above, which encounter the aerosol through carriage motion, followed by entrapping the particulates. In contrast, the extraction system 100 actively draws the aerosol satellites toward the collection location. Here, the collection location is attached to the outlet side of fan 110 as a frame 114 housing a filter segment 115, which may be a fan folded electrostatic filter as described above with respect to filter element 75. The filter element 75 may be considered a permanent installation, or more preferably, may be replaced from time to time as needed. The filter frame 114 may be as described above for frame 76, constructed either of plastic, cardboard or other cellulosic material, for instance. Upon exiting the fan 110, the aerosol is entrapped within the filter media 115. The filtered or clean air is then returned to the interior of the printer enclosure 24, so no new or make-up air needs to be supplied to the printer interior.

FIG. 6 shows the flow path of the aerosol-laden air through the extraction system 100 using arrow 116, following the initial dispersion of inkjet aerosol 118 generated by printheads 64, 66 during printing or spitting. During operation, the air currents produced by the carriage as it reciprocates carry the aerosol particles from the print zone 25, and out from under the trailing side of the carriage, much in the same way dust exits from behind a car traveling down a dirt road. By placing the ducts 104, 105 and inlets 106, 108 on each side of the carriage 50 and in the swept path of the printheads 64, 66, the aerosol is captured when the carriage 50 is moving in either direction during printing.

The manifold assembly may be permanently attached to the carriage 50, for instance, by integrally forming the manifold 102 with the carriage 50 during manufacture. Then the fan and filter units may be attached to the manifold, such as by bolts, screws or other fixtures, or perhaps a snap-fit of plastic interfacing. Alternatively, the manifold 102 may be a separate piece, which is either attached by fasteners (bolts, screws, clips, etc.) to the carriage 50, or with plastic attachment means formed in the carriage and duct work for snap fitting or otherwise securing the two components together. In the illustrated embodiment, the manifold unit 102 is secured to carriage 50 by bonding, using an adhesive or ultrasonic techniques.

Advantageously, prototypes of this extraction system 100 were found to reduce aerosol generated during printing on the order of 10 to 15 times that of a printer without the extraction system 100. By moving the extraction system 100 together with the aerosol generating source, i.e., printheads 64, 66 during printing, aerosol is immediately removed at the source of generation. As a further advantage, this system may be implemented or retrofitted on existing printer designs, with relatively minimal impact upon existing designs.

FIFTH EMBODIMENT

Remote Extraction Fan and Filter

Figure 7:
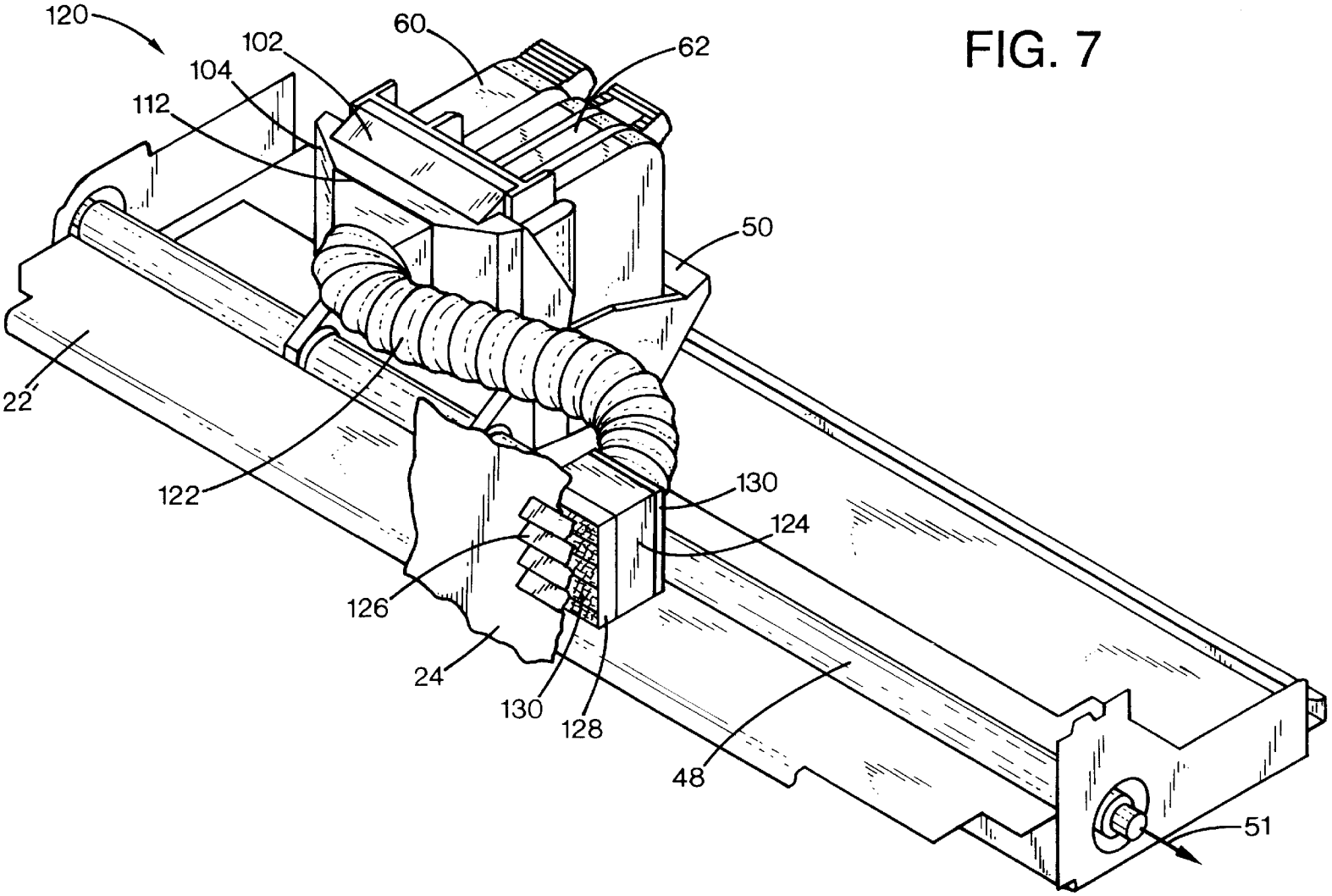
FIG. 7 is an enlarged perspective view of a fifth alternate embodiment of a carriage-mounted aerosol collection system of the present invention.

FIG. 7 illustrates a fifth embodiment of a carriage-mounted inkjet aerosol extraction system, here a remote extraction fan and electrostatic filter system 120 constructed in accordance with the present invention. This remote extraction system 120 uses the same manifold 102 with inlet ducts as described above with respect to FIGS. 5 and 6. However, in this embodiment, the manifold outlet 112 is joined to a flexible conduit or tubing system 122, which couples the manifold outlet to a remotely mounted extraction fan 124. The fan 124 may be as described above for fan 110 (FIG. 6). The fan 124 is preferably mounted to a portion of the printer chassis 22 in a fixed location, such as adjacent an atmospheric vent, such as a set of outlet louvers 126 formed through printer enclosure 24.

A filter frame 128 houses a filter element 130, which is sandwiched between the fan 124 and the outlet louvers 126. Preferably, the filter frame 128 and filter element may be as described above for the filter frame 76 and filter element 75. Alternatively, instead of locating the fan 124 and filter media 130 adjacent to the outlet louvers 126, the cleaned air may also be vented to the printer interior. In the illustrated embodiment, other louvers (not shown) may be used to provide make up air for cleaned air which is extracted through louvers 126, or the make up air may just be drawn inwardly from under the printer 20, or over the paper supply tray 28.

While the remote extraction system 120 of FIG. 7 may appear more complex than system 100 of FIGS. 5 and 6, the remote extraction system 120 may be more suitable in some implementations. For example, locating the fan toward the rear of the printer 20 may reduce the acoustic impact on the operator. Moreover, the remote extraction system minimizes the mass of the carriage 50, increases the ease of changing the filter element 130 when soiled, and allows greater freedom of design in selecting the fan 124 to optimize system operation, such as in terms of fan size, speed, type, etc. It is also easier to provide electrical power to the remote fan unit 124.

Optionally, it may be advantageous to include a prefilter unit 130 with either of the aerosol reduction systems 100 or 120, preferably by placing the prefilter unit directly upstream from either of the fans 110, 124 as shown in FIGS. 6 and 7. Such prefilter preferably accumulates the larger aerosol particles, without impeding air flow, to prevent these larger satellites from collecting on the fans 110, 124. The prefilter unit 130 may include a coarse filter element, which is preferably of an open celled polyurethane foam material, having between 3.88–11.62 pores per square centimeter (25 and 75 pores per square inch), but more preferably 6.20–7.75 pores per square centimeter (40 to 50 pores per square inch), and even more preferably a nominal 6.98 pores per square centimeter (45 pores per square inch). A suitable nominal thickness for the coarse prefilter element is on the order of three millimeters. Other structurally equivalent materials may be used for the coarse filtering media as known to those skilled in the art.

We claim:

1. An inkjet printing mechanism, comprising:

a stationary enclosure;

an inkjet printhead that selectively ejects ink within the enclosure to print an image on a print media and that concurrently generates airborne ink aerosol within the enclosure, with the airborne ink aerosol failing to contact the print media to print the image;

a carriage that reciprocally moves the printhead through the enclosure to print the image; and a passive ink aerosol collection system having an electrostatic collection member supported by the carriage for movement through the enclosure to encounter and entrap at least a portion of the airborne ink aerosol floating therein both adjacent to the printhead and remote from the printhead.

2. An inkjet printing mechanism, comprising:

a stationary enclosure;

an inkjet printhead that selectively ejects ink within the enclosure to print an image on a print media and that concurrently generates airborne ink aerosol within the enclosure, with the airborne ink aerosol failing to contact the print media to print the image;

a carriage that reciprocally moves the printhead through the enclosure to print the image; and an active ink aerosol collection system having (a) an electrostatic filter member, (b) an inlet duct supported by the carriage for movement through the enclosure, and (c) a ventilation component coupled to draw a portion of said airborne ink aerosol from within the enclosure through the inlet duct and through the electrostatic filter member which then electrostatically entraps said portion of the airborne ink aerosol to provide cleaned air.

3. An inkjet printing mechanism according to claim 1 wherein the electrostatic collection member comprises an electrically charged plate.

4. An inkjet printing mechanism according to claim 1 wherein the electrostatic collection member comprises an electrostatic filter.

5. An inkjet printing mechanism according to claim 4 wherein the electrostatic filter comprises a rigid fan-folded filter element.

6. An inkjet printing mechanism according to claim 4 wherein the electrostatic filter comprises a filter element having a billowing sail shaped filter geometry which billows during carriage movement.

7. An inkjet printing mechanism according to claim 4 wherein the electrostatic filter comprises a micron level filter element comprising a fabric having fibers with an impressed electrostatic charge imparted to the fabric by applying a positive static charge to a portion of the filter fibers, and a negative static charge to another portion of the fibers, resulting in a net neutral charge for the total filter fabric.

8. An inkjet printing mechanism according to claim 7 wherein the electrostatic filter comprises a filter element is selected from either a rigid fan-folded filter element or a billowing sail shaped filter element having a geometry which billows during carriage movement.

9. An inkjet printing mechanism according to claim 1 wherein:

the carriage has two opposing sides; and the passive ink aerosol collection system includes a pair of electrostatic collection members mounted on the carriage with the printhead sandwiched therebetween.

10. An inkjet printing mechanism according to claim 1 wherein:

the enclosure defines a carriage chamber through which the carriage moves along a scanning axis, with the carriage chamber having a cross-sectional area perpendicular to the scanning axis; and the electrostatic collection member approximately occupies the cross-sectional area of the carriage chamber.

11. An inkjet printing mechanism according to claim 2 wherein the electrostatic filter member comprises a micron level filter element of a fabric having fibers with an impressed electrostatic charge, with a first portion of the fibers a positive static charge, and a second portion of the fibers having a negative static charge, resulting in a net neutral charge for the filter fabric.

12. An inkjet printing mechanism according to claim 2 wherein the inlet duct comprises a manifold mounted on the carriage, with the manifold having an inlet located adjacent the printhead and an outlet coupled to the electrostatic filter member.

13. An inkjet printing mechanism according to claim 12 wherein the ventilation component comprises a fan unit that couples the manifold outlet to the electrostatic filter member.

14. An inkjet printing mechanism according to claim 13 wherein the fan unit and the electrostatic filter member are each secured to the carriage for reciprocal movement through the enclosure.

15. An inkjet printing mechanism according to claim 12 wherein:

the enclosure defines a vent extending therethrough;

the electrostatic filter is located adjacent to the enclosure vent;

the ventilation component comprises a fan unit that couples the manifold outlet to the electrostatic filter member; and the manifold in part comprises a flexible structure that flexes as the carriages reciprocally moves through the enclosure.

16. A method of operating an inkjet printing mechanism, comprising the steps of:

ejecting ink through an inkjet printhead inside a stationary enclosure to generate a desired ink droplet and a by-product comprising floating ink satellites which float inside the enclosure;

depositing the desired ink droplet at a selected location;

moving the printhead and an electrostatic collection member with a carriage inside the enclosure; and during the moving step, encountering and entrapping at least a portion of the floating ink satellites from inside the enclosure with the electrostatic collection member.

17. A method according to claim 16, wherein the electrostatic collection member comprises an electrostatic filter that attracts the floating ink satellites through electrostatic action.

18. A method according to claim 17 wherein:

the moving step further comprises moving a manifold mounted on the carriage through the enclosure, with the manifold having an inlet located adjacent the printhead and an outlet coupled to the electrostatic filter; and the method further includes the step of moving the floating ink satellites through the manifold by creating a vacuum force with a fan unit to create an air stream through the manifold.

19. A method according to claim 18, further including the step of, after the entrapping step, venting any cleaned air remaining from air stream.

20. A method according to claim 16, wherein the electrostatic collection member comprises an electrically charged plate.

21. A method according to claim 17, wherein the electrostatic filter comprises a rigid fan-folded filter element.

22. A method according to claim 17, wherein the electrostatic filter comprises a micron level filter element of a fabric having fibers with an impressed electrostatic charge, with a first portion of the fibers a positive static charge, and a second portion of the fibers having a negative static charge, resulting in a net neutral charge for the filter fabric.

23. A method according to claim 17, wherein the electrostatic filter comprises a billowing sail shaped filter element having a geometry which billows during the moving step.

24. An inkjet printing mechanism according to claim 2 wherein the active ink aerosol collection system vents at least a portion of the cleaned air away from the printhead.

* * * * *